US005131862A

United States Patent [19]

Gershfeld

[11] Patent Number: 5,131,862

[45] Date of Patent: Jul. 21, 1992

[54] COAXIAL CABLE CONNECTOR RING

[76] Inventor: Mikhail Gershfeld, 1855 Skywood St., Brea, Calif. 92621

[21] Appl. No.: 665,542

[22] Filed: Mar. 1, 1991

[51] Int. Cl.[5] ..... H01R 13/627

[52] U.S. Cl. ..... 439/357; 439/578; 439/923

[58] Field of Search ..... 439/217, 218, 253, 312, 439/313, 314, 317, 318, 345, 350, 352, 357, 578, 923

[56] References Cited

U.S. PATENT DOCUMENTS

| | | | |
|---|---|---|---|
| 3,133,777 | 5/1964 | Anhalt | 439/350 |
| 3,470,524 | 9/1969 | Culver | 439/317 |
| 3,694,793 | 9/1972 | Concelman . | |
| 3,858,156 | 12/1974 | Zarro . | |
| 4,464,001 | 8/1984 | Collins | 439/318 |
| 4,690,481 | 9/1987 | Randolph | 439/585 |
| 4,695,109 | 9/1987 | Ratchford | 439/317 X |
| 4,702,537 | 10/1987 | Mattingly et al. | 439/314 X |
| 4,834,675 | 5/1989 | Samchisen | 439/578 |
| 4,902,238 | 2/1990 | Iacobucci | 439/312 X |
| 4,941,846 | 7/1990 | Guimond et al. | 439/578 |

FOREIGN PATENT DOCUMENTS

| | | | |
|---|---|---|---|
| 2437605 | 2/1975 | Fed. Rep. of Germany | 439/312 |

OTHER PUBLICATIONS

Newark Electronics Catalog #111 (1990), pp. 642-643.

*Primary Examiner*—Larry I. Schwartz
*Assistant Examiner*—Khiem Nguyen
*Attorney, Agent, or Firm*—Robert T. Spaulding

[57] ABSTRACT

A resilient C shaped connector ring is described which can be snapped onto a BNC type coaxial connector plug. The connector ring includes a pair of short protrusions that prevent the outer shell of the modified BNC type coaxial connector plug from rotating. Also included is a pair of long protrusions that provide a gripping action when the modified BNC type coaxial connector plug is installed.

5 Claims, 1 Drawing Sheet

COAXIAL CABLE CONNECTOR RING

FIELD OF THE INVENTION

This invention relates generally to quick connect/disconnect coaxial connectors and more specifically to the modification of a standard BNC type coaxial connector plug to incorporate this feature.

BACKGROUND OF THE INVENTION

Quick connect/disconnect coaxial connectors are well known in the art in examples such as U.S. Pat. Nos. 3,858,156, 4,941,846, and 4,834,675. All of these devices incorporate the highly desireable quick connect/disconnect feature, but in so doing, each device requires its own unique plug and unique jack. None of these prior art devices are interchangeable.

Accordingly, one object and advantage of this invention is the ability to transform any standard BNC type coaxial connector plug into a quick connect/disconnect BNC type coaxial connector plug without requiring changes or modifications to the corresponding BNC type coaxial connector jack. Thus, any BNC type coaxial connector jack will receive either a standard BNC type coaxial connector plug or the modified quick connect/disconnect BNC type coaxial connector plug. In like manner, the modified quick connect/disconnect BNC type coaxial connector plug will mate with any BNC type coaxial connector jack. Moreover, the connector ring used to perform this modification may be instantly snapped into place or removed from the BNC type coaxial connector plug as circumstances require.

Another object and advantage of this invention is the significant decrease in the amount of space required for the installation of an array of panel mounted BNC type coaxial connector jacks when they are to be used in conjunction with the modified BNC type coaxial connector plug.

Another object and advantage of this invention is to incorporate a safety feature by providing a strain relief against untoward stress.

Further objects and advantages of this invention will become apparent from a consideration of the drawings and ensuing description of it.

REFERENCE NUMERALS IN DRAWINGS

Figure 1:
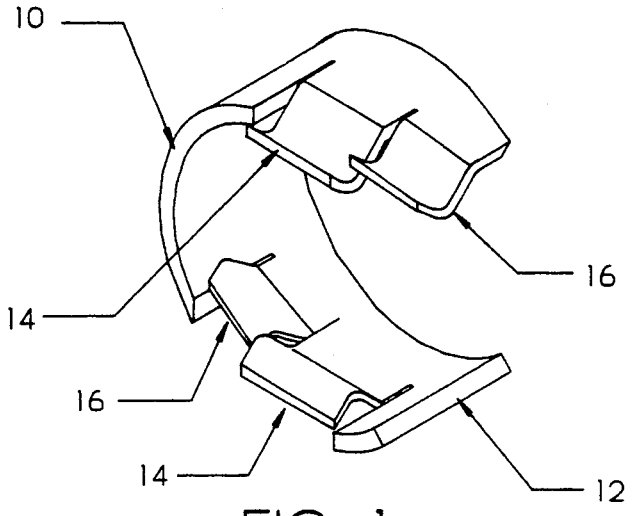
FIG. 1 is a perspective view of the connector ring.
Figure 2:
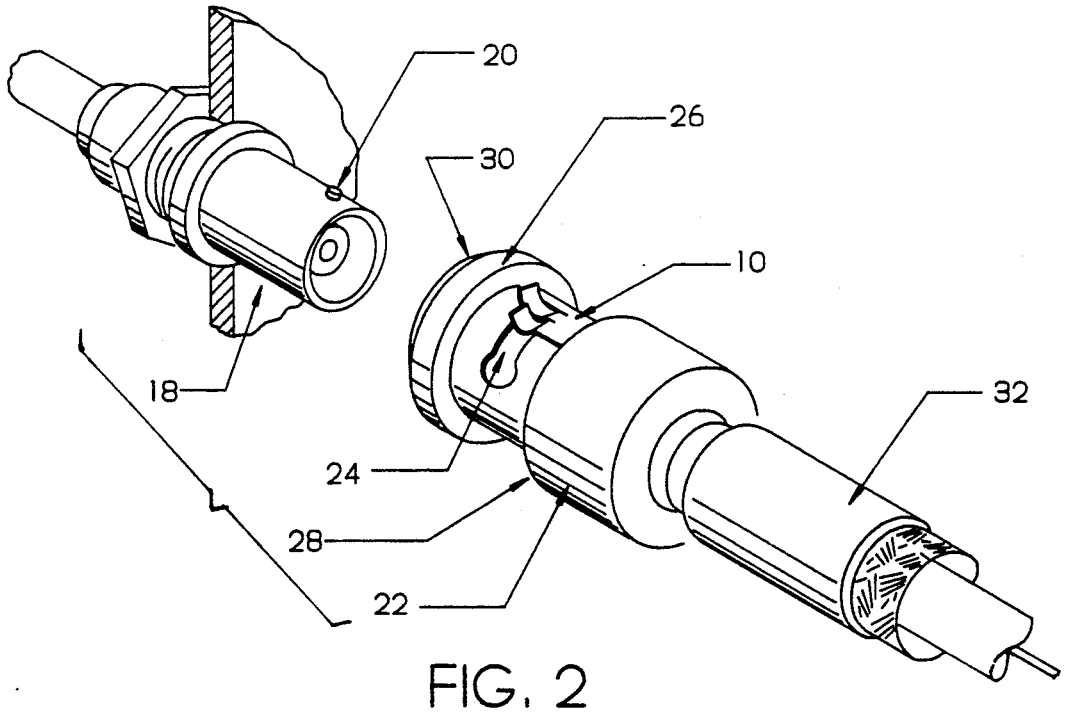
FIG. 2 is a perspective view of a modified quick connect/disconnect BNC type coaxial connector plug in alignment with a BNC type coaxial connector jack.

| FIG. 1 | | FIG. 2 | |
|---|---|---|---|
| 10 | Connector Ring | 10 | Connector Ring |
| 12 | Guide Lip | 18 | Panel Mounted BNC Type Coaxial Connector Jack |
| 14 | Long Protrusion (2) | 20 | Connecting Pin |
| 16 | Short Protrusion (2) | 22 | Modified BNC Type Coaxial Connector Plug |
| 24 | Coupling Slot (2) | | |
| 26 | Coupling Flange | | |
| 28 | Knurled Gripping Flange | | |
| 30 | Outer Shell | | |
| 32 | Coaxial Cable | | |

BEST MODE FOR CARRYING OUT THE INVENTION

FIG. 1 shows a perspective view of the connector ring 10. The connector ring 10 comprises a guide lip 12, two long protrusions 14, and two short protrusions 16. Each of the four protrusions is shaped to provide a detent. One long protrusion 14 and one short protrusion 16 are located adjacent to each other and are diametrically opposed from the remaining adjacently located short protrusion 16 and long protrusion 14.

FIG. 2 shows a perspective view of a panel mounted BNC type connector jack 18 and a connector ring 10 equipped BNC type coaxial connector plug 22. Formed of a resilient material, the C shaped connector ring 10 is of sufficient width to completely fit within the shallow gap located between the coupling flange 26 and the knurled gripping flange 28.

To install, the connector ring 10 is presented to the BNC type coaxial connector plug 22 with the protrusions facing the coupling flange 26. The guide lip 12 FIG. 1 is inserted in the shallow gap found between the coupling flange 26 and the knurled gripping flange 28. The large protrusion 14 FIG. 1 adjacent to the guide lip 12 FIG. 1 is then aligned with either of the two diametrically opposed junctions of the coupling flange 26 and coupling slot 24. Pressure on the connector ring 10 will cause it to snap into place. So installed, the diametrically opposed long protrusions 14 FIG. 1 are located at the junctions of the coupling flange 26 and coupling slots 24. Each of the short protrusions 16 FIG. 1 are located within a coupling slot 24 and prevent the outer shell 30 from rotating.

When the BNC type coaxial connector plug 22 is mated to the BNC type coaxial connector jack 18, each of the two long protrusions 14 FIG. 1 will ride over a corresponding connecting pin 20 and grip the BNC type coaxial connector plug 22 in place. Opposite pressure will cause the BNC type coaxial connector plug 22 to disengage. This opposite pressure is less than that required to pull the coaxial cable 32 from the BNC type coaxial connector plug 22.

Although the description above contains many specifications, these should not be construed as limiting the scope of the invention but as merely providing illustrations of some of the presently preferred embodiments of this invention. For example, the four protrusions can have other shapes, such as slots, at the terminal end; the connector clip may be made of metal or plastic, etc.

Thus the scope of the invention should be determined by the appended claims and their legal equivalents, rather than by the examples given.

What is claimed is:

1. In combination, a BNC type coaxial connector plug having an outer shell, a knurled gripping flange, and a coupling flange; and a coaxial connector ring which is mounted on said plug, the connector ring, made of a resilient material, comprising a plurality of short protrusions about the circumference of the ring which prevents the normal rotational capability of the outer shell of the plug, and a plurality of long protrusions about the circumference of the ring which, upon mating the combination to a BNC jack with lock pins, said protrusions will ride over corresponding lock pins of the jack that lie in conjunction and latch the connector plug in place; thus converting the normal rotational engagement of plug and jack to a resilient latch engagement.

2. The coaxial connector plug of claim 1 wherein the circumference of said connector ring is greater than one half the circumference of that part of the BNC type coaxial connector plug that lies between the coupling flange and the knurled gripping flange.

3. The coaxial connector plug of claim 1 wherein said protrusions are distributed in diametrically opposed pairs, the members of each pair being of unequal length.

4. A quick connect, quick disconnect BNC type coaxial connector plug comprising: a) a BNC type coaxial connector plug having an outer shell, a knurled gripping flange, and a coupling flange; b) a coaxial connector ring, made of a resilient material, which is fixed to the outer shell of the BNC plug and is of sufficient width to span the distance between the coupling flange and the knurled gripping flange of the BNC plug, thereby converting the normal rotational engagement of the plug to a resilient latching engagement by spring means to lock pins of a mating BNC jack.

5. The coaxial connector plug of claim 4 wherein said spring means comprises a plurality of protrusions which are distributed about the circumference of the connector ring in diametrically opposed pairs, the members of each pair being of unequal length.

* * * * *